US007931155B2

(12) United States Patent
Bastuji

(10) Patent No.: US 7,931,155 B2
(45) Date of Patent: Apr. 26, 2011

(54) DISHWASHER HAVING A POSITIONABLE HOLDER

(76) Inventor: Cem Bastuji, Istanbul (TR)

( * ) Notice: Subject to any disclaimer, the term of this patent is extended or adjusted under 35 U.S.C. 154(b) by 776 days.

(21) Appl. No.: 11/568,757

(22) PCT Filed: Apr. 29, 2005

(86) PCT No.: PCT/IB2005/051414

§ 371 (c)(1),
(2), (4) Date: Nov. 28, 2006

(87) PCT Pub. No.: WO2005/107570

PCT Pub. Date: Nov. 17, 2005

(65) Prior Publication Data

US 2007/0226928 A1 Oct. 4, 2007

(30) Foreign Application Priority Data

May 6, 2004 (TR) ..... A 2004 01017

(51) Int. Cl.
*A47G 19/08* (2006.01)
*B08B 3/00* (2006.01)

(52) U.S. Cl. ..... 211/41.9; 211/41.8; 134/56 D; 134/57 D; 134/58 D

(58) Field of Classification Search ..... 134/56 D, 134/57 D, 58 D; 211/41.8, 41.9
See application file for complete search history.

(56) References Cited

U.S. PATENT DOCUMENTS

| | | | | |
|---|---|---|---|---|
| 3,341,170 | A * | 9/1967 | Housworth | 251/306 |
| 3,752,322 | A * | 8/1973 | Fiocca et al. | 211/41.8 |
| 5,601,195 | A * | 2/1997 | Finola et al. | 211/41.8 |
| 6,848,585 | B2 * | 2/2005 | VanLandingham | 211/41.9 |
| 7,231,929 | B2 * | 6/2007 | Landsiedel et al. | 134/135 |
| 2005/0039782 | A1 * | 2/2005 | Kim | 134/58 D |

FOREIGN PATENT DOCUMENTS

| | | | |
|---|---|---|---|
| DE | 4041576 | A1 * | 6/1992 |
| DE | 29714515 | U1 | 10/1997 |
| DE | 20104114 | U1 | 5/2001 |
| FR | 2775180 | A | 8/1999 |
| FR | 2775180 | A1 * | 8/1999 |

* cited by examiner

*Primary Examiner* — Michael Barr
*Assistant Examiner* — Charles W Kling
(74) *Attorney, Agent, or Firm* — Venable, Campillo, Logan & Meaney PC

(57) ABSTRACT

A dishwasher including a basket having a holder whose position may be easily changed using a lever from an active state to a passive state, by folding ergonomically, so that different kinds of kitchenware may be washed, such as saucepans, pans, etc. or plates, glasses, etc. The active position of the holder is utilized to hold such kitchenware such as plates, glasses etc. at right or certain inclined angles in order for the mentioned type of kitchenware to be washed easily at the lower and upper basket.

19 Claims, 4 Drawing Sheets

DISHWASHER HAVING A POSITIONABLE HOLDER

This invention relates to a dishwasher comprising a basket wherein means are provided to utilize the space on the said basket in a most efficient manner.

The lower and upper baskets utilized in dishwashers are formed by assembling wires, preferably coated with plastic material, using various techniques. Supporting wires are formed to enable such kitchenware as plates, glasses etc. to stand vertical or inclined at certain angles in order for the mentioned type of kitchenware to be easily washed in the lower and upper baskets, and supporting wires are positioned at right angle or inclined to the basal plane of the basket, fixed to the wires forming the said base. By means of the said supporting wires, it is achieved to increase the space where the kitchenware can be placed without falling, however, the use of the mentioned stationary supporting wires makes the placing and washing of such large kitchenware as saucepans, pans etc. difficult. In the current state of the art, it is attempted to solve that problem by taking the holder that incorporates supporting wires produced independently of the basket out as a single piece by the user or by producing the holder on the basket in such a way that the user can fold it, if necessary.

In the current state of the art, in the U.S. Pat. No. 5,601,195, a description is given of an application wherein, the holder is brought to a position perpendicular or parallel to the base of the basket by the user by means of a component mounted to the wires which form the lateral frame of the said basket.

In another application of the current state of the art, in the German Utility Model Document DE 29714515, a description is given of a fastener mounted to the wires which form the lateral frame of the basket, whereby the holder is positioned vertical or horizontal on the basket by fitting an arm located on the said holder, used to move the holder by the user manually.

The object of the present invention is the realization of a dishwasher comprising a basket wherein means are provided to utilize the space on the said basket in an efficient manner.

Figure 1:
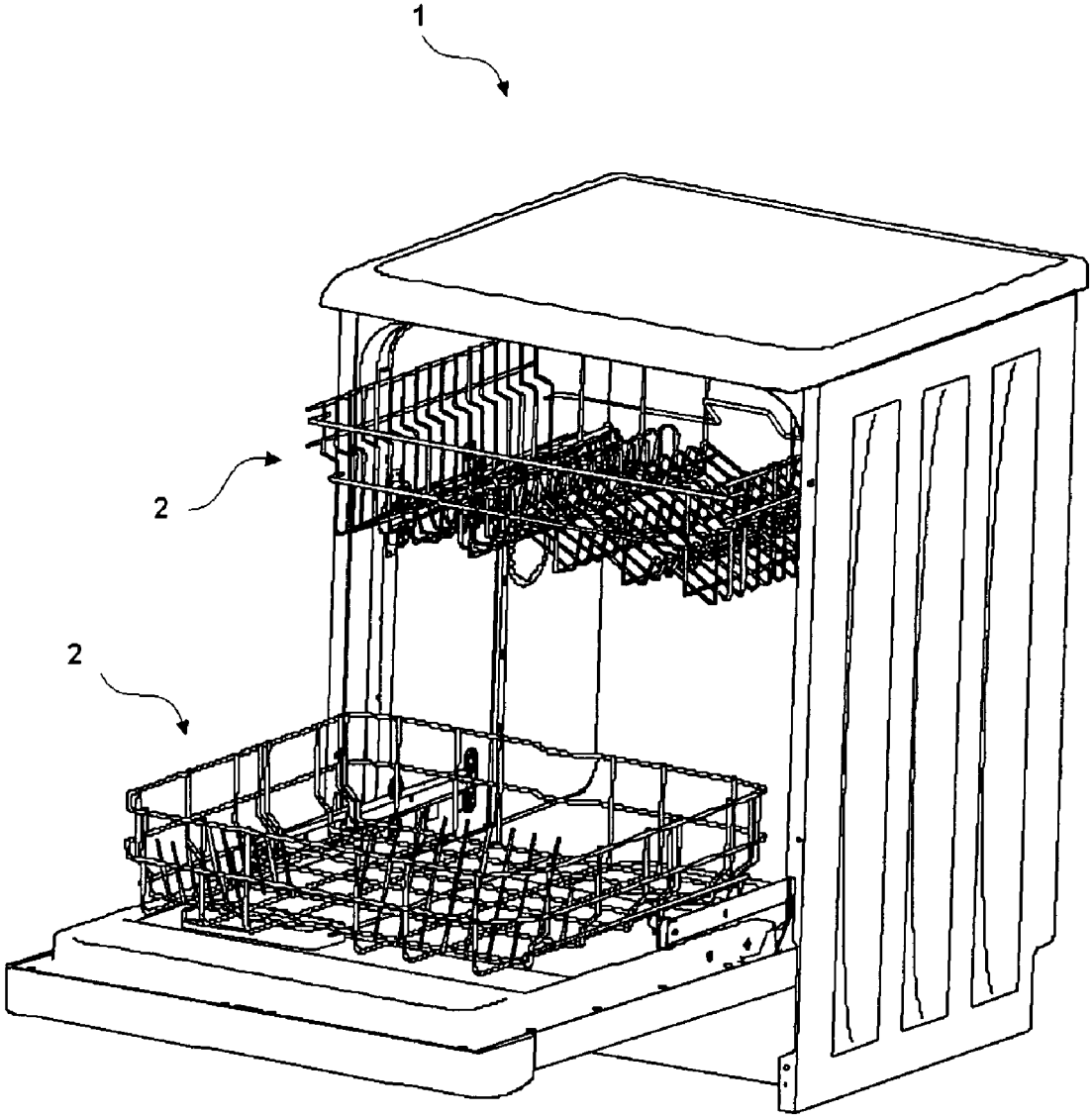

The dishwasher designed to fulfill the object of the present invention is illustrated in the attached figures where:

FIG. 1—is a perspective view of a dishwasher.

Figure 2:
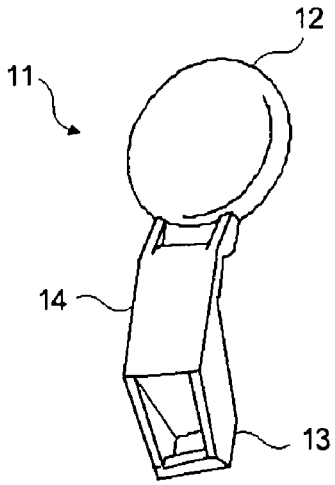

FIG. 2—is a rear perspective view of a lever.

Figure 3:
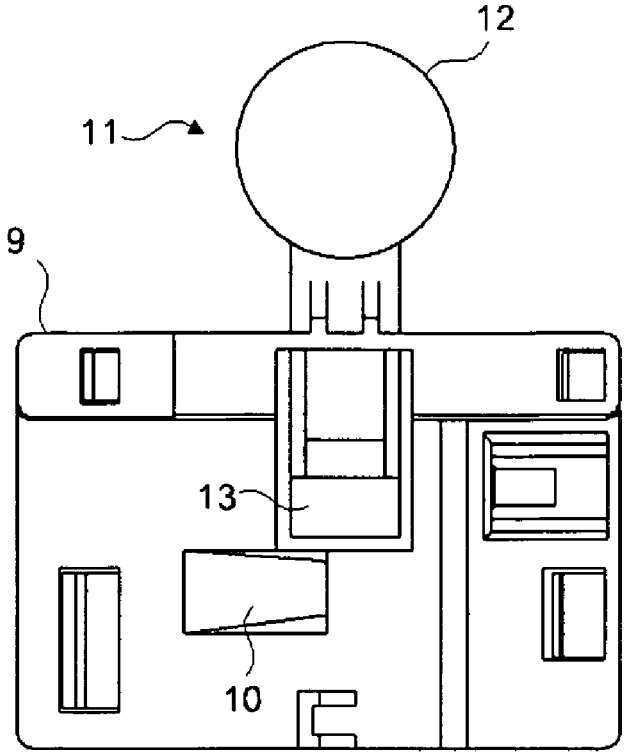

FIG. 3—is a front view of a locking mechanism with a lever on it.

Figure 4:
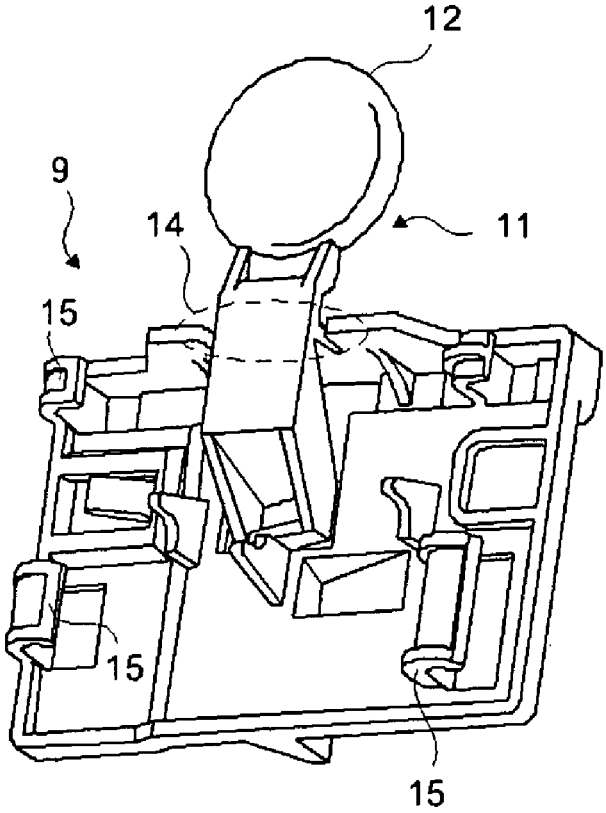

FIG. 4—is a rear perspective view of a locking mechanism with a lever on it.

Figure 5:
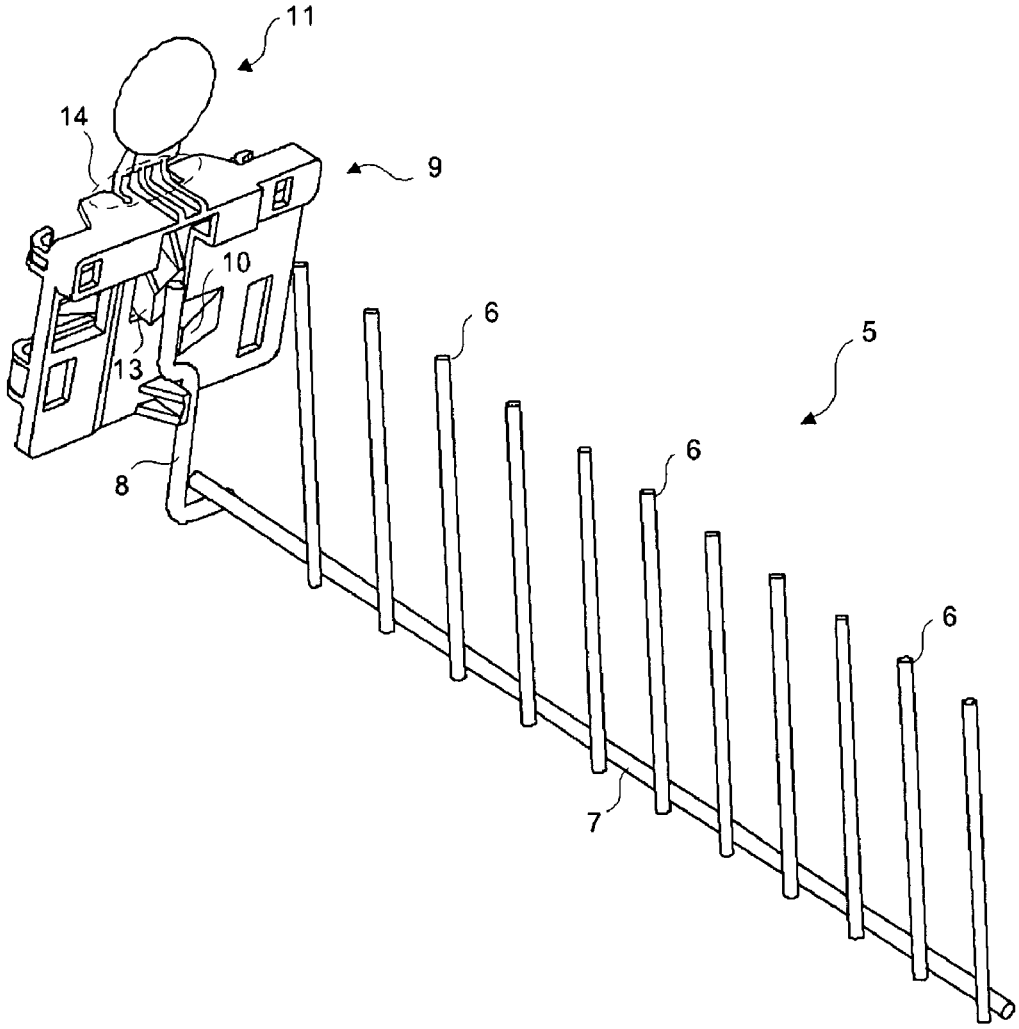

FIG. 5—is a perspective view of a locking mechanism, a lever and a holder together.

Figure 6:
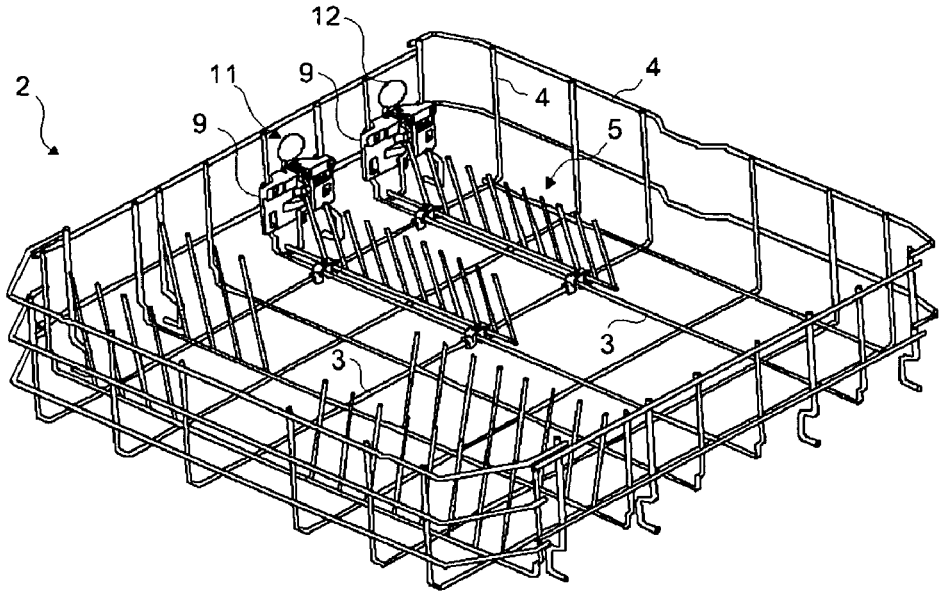

FIG. 6—is a perspective view of a basket while two holders are in active position.

Figure 7:
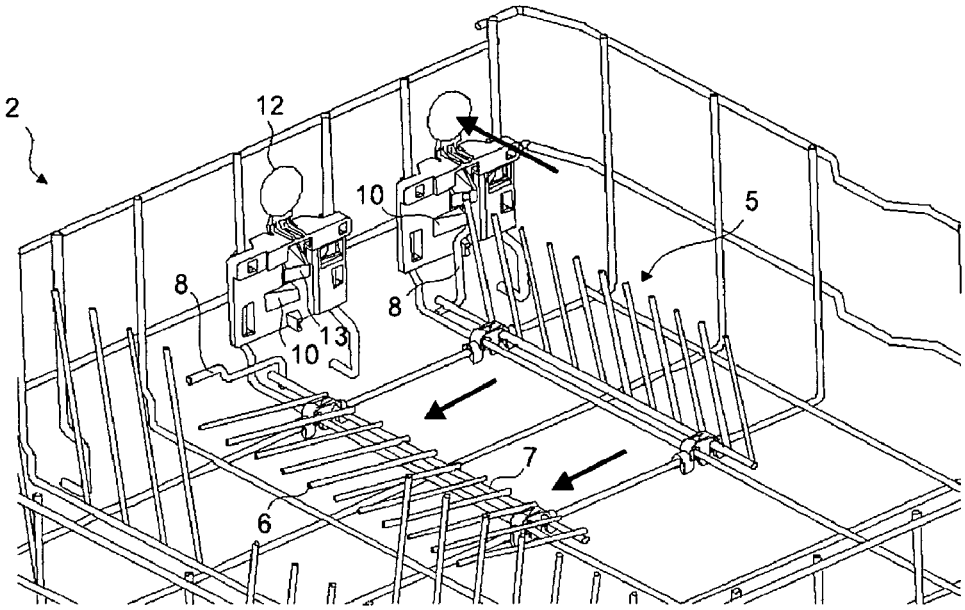

FIG. 7—is a detailed perspective view of a basket while one of the two holders is in active position and the other is in passive position.

Figure 8:
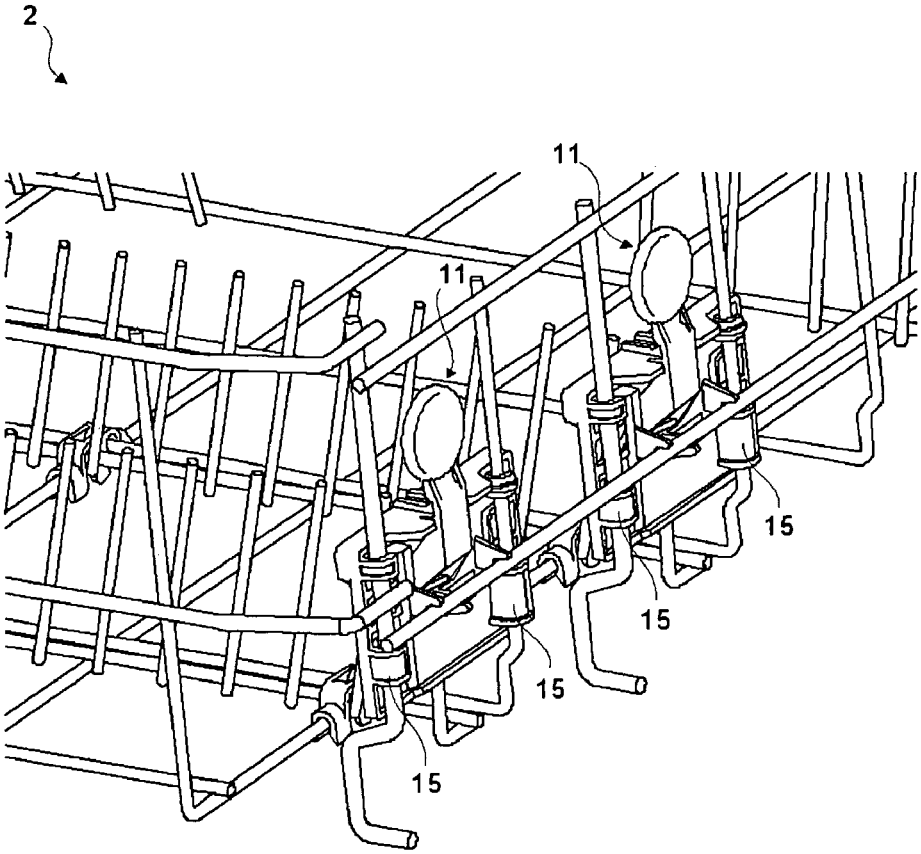

FIG. 8—is a detailed perspective view of a basket where a locking mechanism and a lever are fastened onto.

Parts shown in figures are numbered as follows:

1. Dishwasher
2. Basket
3. Base wire
4. Side wire
5. Holder
6. Supporting wire
7. Connecting wire
8. Holding arm
9. Locking mechanism
10. Locker

11. Lever
12. Application surface
13. Transfer surface
14. Lever support
15. Fastening piece The dishwasher (1), which is the object of the present invention, comprises a basket (2) where items to be washed are placed into, formed by assembling the base wires (3) positioned latitudinally and/or longitudinally to the basal plane and the side wires (4) surrounding the mentioned base wires (3), preferably positioned perpendicular to the basal plane, a connecting wire (7) mounted onto the said basket (2), used to obtain a desired position of the mentioned items in order for them to be washed effectively, one or more than one supporting wire (6) fixed to the said connecting wire (7) so as to be preferably parallel to each other and holder (5) incorporates a holding arm (8) whereby the holder (5) is brought to active and/or passive position by being rotated by the user about the connecting wire (7), a locking mechanism (9) attached onto the basket (2), which incorporates a locker (10) where the holding arm (8) is fitted into in order to fix the position of the holder (5) as the holder (5) is brought to active position and, a lever (11) whereby it is achieved that the applied force is transferred to the holding arm (8) fitted to the locker (10) so that the said holding arm (8) detaches from the said locker (10) and that the holder (5) folds onto the base of the basket (2) by being brought back from active position to passive position (FIG. 1, FIG. 5, FIG. 6 and FIG. 7). FIG. 1 includes a basket (2) of the invention in which the holder (5) can be placed as shown in FIGS. 5 and 6.

In the preferred embodiment of the present invention, the dishwasher (1) comprises a lever (11) whereby it is achieved that the applied force is transferred to the holding arm (8) fitted to the locker (10), as its one end moves in the direction of the applied force whereas the other end moves in the opposite direction of the applied force, so that the said holding arm (8) detaches from the said locker (10) and that the holder (5) folds onto the base of the basket (2) by being brought back from active position to passive position.

In an alternative embodiment of the present invention, the dishwasher (1) comprises a lever (11) whereby it is achieved that the applied force is transferred to the holding arm (8) fitted to the locker (10), as its one end moves in the direction of the applied force while the other end moves also in the same direction of the applied force, so that the said holding arm (8) detaches from the said locker (10) and that the holder (5) folds onto the base of the basket (2) by being brought back from active position to passive position.

The locking mechanism (9) comprises at least one fastening piece (15) whereby it is fixed to the basket (2) preferably by being attached to the side wires (4) of the said basket (2).

The locker (10) positioned on the locking mechanism (9) has a structure with one or more than one projections or recesses where the holding arm (8) on the holder (5) fits into as the holder (5) is in active position—the active position is, preferably, a position where supporting wires (6) of the holder (5) are inclined at a certain angle or in an approximately perpendicular plane to the basal plane of the basket (2)—and prevents the holder (5) from switching from active position back to the passive position—the passive position is, preferably, a position where supporting wires (6) of the holder (5) are in an approximately parallel plane to the basal plane of the basket (2)—without the application of any force to the holding arm (8). Due to the mentioned structure of the locker (10), it is prevented that the holder (5) is undesirably brought from the active to the passive position by bending due to the force applied to the holder (5) by the kitchenware placed onto the basket (2) by the user as the holder (5) is in active position. The form of the locking mechanism (9) is such that it is easily attached to and detached from the basket (2), as desired (FIG. 3, FIG. 4 and FIG. 8).

In the preferred embodiment of the present invention, in order for the holding arm (8) which preferably moves parallel to the surface of the locking mechanism (9), to pass over easily, the locker (10) is in the form of a projection the height of which increases in the direction of the motion of the holding arm (8). As the holding arm (8) passes over the said projection, it attains the active position and unless there is a force applied, it stays behind the said projection thereby preventing the holder (5) from switching back to the passive position. In the alternative embodiment of the present invention, the locker (10) may be produced in the form of such recess as a crack, groove or housing.

The holder (5) moves in the basket (2) as the holding arm (8) fastened to the connecting wire (7) moves preferably parallel to the surface of the locking mechanism (9). As the holding arm (8) may be at the same plane with the supporting wires (6) fastened to the connecting wires (7), it may be at a different plane as well (FIG. 5).

The lever (11) comprises a lever support (14) whereby it is fastened to the locking mechanism (9) or to the basket (2), an application surface (12) at its one end whereby external force is applied and, a transfer surface (13) at its other end whereby applied force is transferred to the holding arm (8). The lever (11) is mounted at such a distance that, if a force capable of changing the position of the holder (5) from active to passive is applied to the application surface (12), the transfer surface (13) can transfer the said force to the holding arm (8) fitted to the locker (10). The transfer surface (13) applies the force to the holding arm (8) at a point wherein a minimum force is sufficient for the holder (5) to change its position from active to passive, preferably at the farthest point to the connecting wire (7). In addition, the transfer surface (13) is preferably an inclined surface such that the holding arm (8) fitted to the locker (10) is subjected to a force in the desired folding direction of the holder (5) onto the basket (2) (FIG. 2, FIG. 3 and FIG. 4).

If a force is applied to the application surface (12) of the lever (11), the said application surface (12) at one side of the lever support (14) moves in the direction of the applied force whereas the transfer surface (13) at the other side of the lever support (14) moves in the same, or preferably opposite, direction of the applied force by moving about the mentioned lever support (14). As a result of the said motion, the transfer surface (13) moves proportional to the force applied to the application surface (12) and contacts the holding arm (8) fitted to the locker (10). As the force applied to the application surface (12) continues in an increasing manner, the transfer surface (13) transfers it to the holding arm (8) thereby moving the holding arm (8) in the opposite direction of the force applied to the application surface (12). If the force transferred to the transfer surface (13) by the application surface (12) is sufficiently large to make the holding arm (8) detach from the locker (10), by detaching from the locker (10), the holding arm (8) changes its position from active to passive, namely it folds onto the basket (2). When the force applied to the application surface (12) is removed, the lever (11) comes back to its original position. As the transfer surface (13) can move in the opposite direction of the force applied to the application surface (12), it can also move in the same direction (FIG. 6 and FIG. 7).

In the preferred embodiment of the present invention, one or more than one lever (11) is in a single piece with the locking mechanism (9) (FIG. 3 and FIG. 4). Also, the lever (11) can easily be mounted to the wires forming the basket (2) and, it can be attached and detached by the user.

Through the use of a lever (11) in the dishwasher (1), which is the object of the present invention, it is achieved to place such large kitchenware as saucepans, pans etc. to the basket (2) and, to easily change the position of the holder (5) in active position to passive position by the user, by folding ergonomically while not touching the holding arm (8) wherein the said active position of the holder (5) is utilized to hold such kitchenware as plates, glasses etc. at right or certain inclined angles in order the mentioned type of kitchenware to be washed easily at the lower and upper basket (2).

The invention claimed is:

1. A dishwasher comprising:

a basket where items to be washed are placed into;

a holder mounted onto the said basket, used to obtain a desired position for the items to be washed wherein the holder includes a holding arm wherein the holder is brought to active or passive position by a user and;

a locking mechanism attached onto the basket, including a locker and a lever wherein the locker is fitted for the holding arm in order to fix the position of the holder as the holder is brought to active position and wherein the lever detaches the holding arm from the locker by an applied force to the lever and wherein the holder folds onto the base of the basket by being brought back from active position to passive position.

2. A dishwasher as described in claim 1, wherein the applied force is transferred from the lever to the holding arm fitted to the locker, as the lever's one end moves in the direction of the applied force whereas the lever's other end movement is in a direction so that the said holding arm detaches from the said locker and that the holder folds onto the base of the basket by being brought back from active position to passive position.

3. A dishwasher as described in claim 1, wherein the lever further comprises a lever support having an application surface at the lever support's one end where an external force can be applied and a transfer surface at the lever support's other end where the applied force is transferred to the holding arm.

4. A dishwasher as described in claim 3, wherein the transfer surface in such a form that the holding arm fitted to the locker is subjected to a force in the desired folding direction of the holder onto the basket.

5. A dishwasher as described in claim 4, wherein the transfer surface applies the force to the holding arm at a point on the holding arm wherein a minimum force is sufficient for the holder to change its position from active to passive.

6. A dishwasher as described in claim 4 wherein the transfer surface applies the force to the holding arm at the farthest point from the connecting wire.

7. A dishwasher as described in claim 4 wherein the transfer surface in an inclined form.

8. A dishwasher as described in claim 4 wherein the lever is mounted at such a distance that, if a force capable of changing the position of the holder from active to passive is applied to the application surface, the transfer surface can transfer the said force to the holding arm fitted to the locker.

9. A dishwasher as described in claim 3, wherein the transfer surface applies the force to the holding arm at a point on the holding arm wherein a minimum force is sufficient for the holder to change its position from active to passive.

10. A dishwasher as described in claim 9 wherein the transfer surface applies the force to the holding arm at the farthest point from the connecting wire.

11. A dishwasher as described in claim 9 wherein the transfer surface in an inclined form.

12. A dishwasher as described in claim 9 wherein the lever is mounted at such a distance that, if a force capable of changing the position of the holder from active to passive is applied to the application surface, the transfer surface can transfer the said force to the holding arm fitted to the locker.

13. A dishwasher as described in claim 3 wherein the holder includes a connecting wire and wherein the transfer surface applies the force to the holding arm at the farthest point from the connecting wire.

14. A dishwasher as described in claim 13 wherein the transfer surface in an inclined form.

15. A dishwasher as described in claim 13 wherein the lever is mounted at such a distance that, if a force capable of changing the position of the holder from active to passive is applied to the application surface, the transfer surface can transfer the said force to the holding arm fitted to the locker.

16. A dishwasher as described in claim 3 wherein the transfer surface in an inclined form.

17. A dishwasher as described in claim 3 wherein the lever is mounted at such a distance that, if a force capable of changing the position of the holder from active to passive is applied to the application surface, the transfer surface can transfer the said force to the holding arm fitted to the locker.

18. A dishwasher as described claim 1 wherein the locking mechanism further comprises a single piece including one or more than one lever.

19. A dishwasher as described in claim 1, wherein the locking mechanism comprises at least one fastening piece wherein the locking mechanism is fixed to side wires of the basket and wherein the locker and the holding arm of the holder when brought to active position form a projection that prevents the said holder from changing its position to passive without the application of any force to the holder arm.

* * * * *